United States Patent [19]

Newsom

[11] 4,299,64

[45] Nov. 10, 198

[54] METHOD FOR ASSEMBLING FABRIC TO AN ARTICLE OF FURNITURE

[76] Inventor: Charles R. Newsom, 6208 Rocky Falls Rd., Charlotte, N.C. 28211

[21] Appl. No.: 154,539

[22] Filed: May 30, 1980

[51] Int. Cl.[3] ..... B32B 31/04

[52] U.S. Cl. ..... 156/258; 139/424; 156/293; 297/443; 297/444

[58] Field of Search ..... 156/256, 258, 293, 267, 156/514, 517, 423; 139/424; 297/219, 440, 441, 443, 444, 457, 463, DIG. 2; 160/369; 140/109

[56] References Cited

U.S. PATENT DOCUMENTS

| | | | |
|---|---|---|---|
| 1,792,762 | 2/1931 | Rockwell | 144/319 |
| 2,033,734 | 3/1936 | Oakley | 160/369 |
| 2,119,667 | 6/1938 | Crowe | 160/369 |

*Primary Examiner*—Caleb Weston

*Attorney, Agent, or Firm*—Bell, Seltzer, Park & Gibson

[57] ABSTRACT

A method is provided for assembling a fabric materi such as woven cane, in a channel which surrounds opening in an article of furniture, and which eliminat the usual manual edge trimming operation. The meth includes the steps of cutting the fabric material into component having a predetermined outline which co forms in an oversized relationship to the outline of tl channel in the article of furniture, applying indicia the component at at least two predetermined locatio which are specifically located with respect to the ou line of the associated channel of the article of furnitur placing the fabric component to overlie the opening the article of furniture while utilizing the indicia accurately orient the component with respect to tl opening, and then forcing the peripheral edge of tl component into the channel. By design, the entire e tent of the peripheral edge of the component enters tl channel, so that no portion of the edge extends out fro the channel, and thus no manual trimming is requirec

10 Claims, 10 Drawing Figures

METHOD FOR ASSEMBLING FABRIC TO AN ARTICLE OF FURNITURE

The present invention relates to a method for assembling a fabric material, such as woven cane, in a peripheral channel or groove which surrounds an opening in an article of furniture, and so as to cover the opening therein.

Cane has long been utilized in forming the seat or back of chairs. Traditionally, strands of the cane were hand woven directly across the opening of the seat or back, but more recently, it has become common to initially weave the strands of either natural cane, or a similar paper based material (referred to in the art as paper cane) into a desired pattern, and then to secure cut components of the pre-woven material across the opening in the furniture. More particularly, a peripheral channel or groove is initially routed or otherwise formed about the opening in the furniture, and the woven cane, which is typically supplied in large rolls, is then cut into oversized components which are positioned across the opening in the seat or back. The edge of the component is then forced into the channel by means of a die or suitable hand tool. In the case of natural cane, the component is preferably soaked in water just prior to being forced into the channel, to soften the material and facilitate its entry into the channel without breakage of the strands. Since the cane component is oversized, a peripheral outer edge portion extends from the routed channel after being forced therein, and this excess edge portion is manually severed, using a hand held knife. To lock the cane in the routed channel, glue is often applied over the cane in the channel, and a spline is usually forced over the cane in the glued channel to retain the edge of the cane therein.

The required manual cutting of the excess edge portion of the cane not only increases the cost of the assembly operation by reason of the labor and time required, but also, this operation often tends to distort the cane pattern along the severed edges to thereby result in a non-uniform appearance. Also, the knife often slips onto the finished portion of the furniture, causing a visible line or crease. Finally, as will be apparent, the severing operation is dangerous to the laborer.

As a further disadvantage of the above present procedure, the woven cane components are not always assembled with the cane pattern consistently oriented from chair to chair, to thereby produce non-uniformity in appearance among a given set of chairs.

It is accordingly an object of the present invention to provide a method for assembling a fabric material to cover an opening in an article of furniture, and which effectively overcomes the above noted deficiencies of the present procedure.

It is a more particular object of the present invention to provide a method for assembling a woven cane material to cover an opening in an article of furniture, which minimizes manual operations, and in particular, eliminates the edge trimming operation.

It is still another object of the present invention to provide a method for assembling a woven cane material to an article of furniture, and wherein the pattern of the woven cane is consistently aligned and oriented on each article of furniture, so as to provide uniformity from article to article.

These and other objects and advantages of the present invention are achieved in the embodiment illustrated herein by the provision of a method which i cludes the steps of cutting the fabric material into co ponents which have a peripheral edge which accurate conforms in a predetermined oversized relationship the peripheral outline of the channel in the article furniture, and so that the component is adapted to ove lie the opening in the article of furniture with the enti extent of the peripheral edge of the component bei disposed within the channel. Next, indicia are applied at least two widely spaced positions on the compone with the positions being respectively disposed at prec termined locations with respect to the peripheral o line of the associated channel. Thereafter, the comp nent is aligned so as to overlie the opening in the artic of furniture, and the indicia are located at the predet mined locations with respect to the peripheral outline the channel in the article of furniture. Finally, the p ripheral edge of the component is forced into the cha nel. Since by design the entire peripheral edge of t component is thereby disposed within the channel, portion thereof extends from the channel after bei forced therein, and as a result, there is no need for tri ming any excess edge portion.

In the preferred embodiment, the fabric material initially cut into rectangular segments, which are co sistently oriented in a predetermined manner with spect to the weave pattern. During the cutting step, t edge of the resulting segment is oriented in a predet mined manner with respect to the predetermined lo tions, so that the pattern of the woven material is cons tently oriented with respect to its edge, and with t predetermined locations, from component to comp nent.

Some of the objects and advantages of the inventi having been stated, others will appear as the descripti proceeds, when taken in connection with the accomp nying drawings, in which FIG. 1 is a flow chart indicating the steps of t method of the present invention;

Referring more specifically to the drawings, the pr ent invention is illustrated and described herein in as ciation with the wooden chair back 12 (FIG. 7) prior its being fabricated into a completed dining room ch or the like. The chair back includes an opening hich is surrounded by a channel 15 routed in one face ereof, and the present invention relates to the assemy of an openwork, woven cane material to cover the ening 14 in the chair back. It will be understood owever, that the novel features of the present invenon are not limited to the assembly of woven cane in a air back, and are equally applicable in any number of milar assembly operations where a fabric is assembled a continuous channel formed in an article of furnire.

Figure 1:
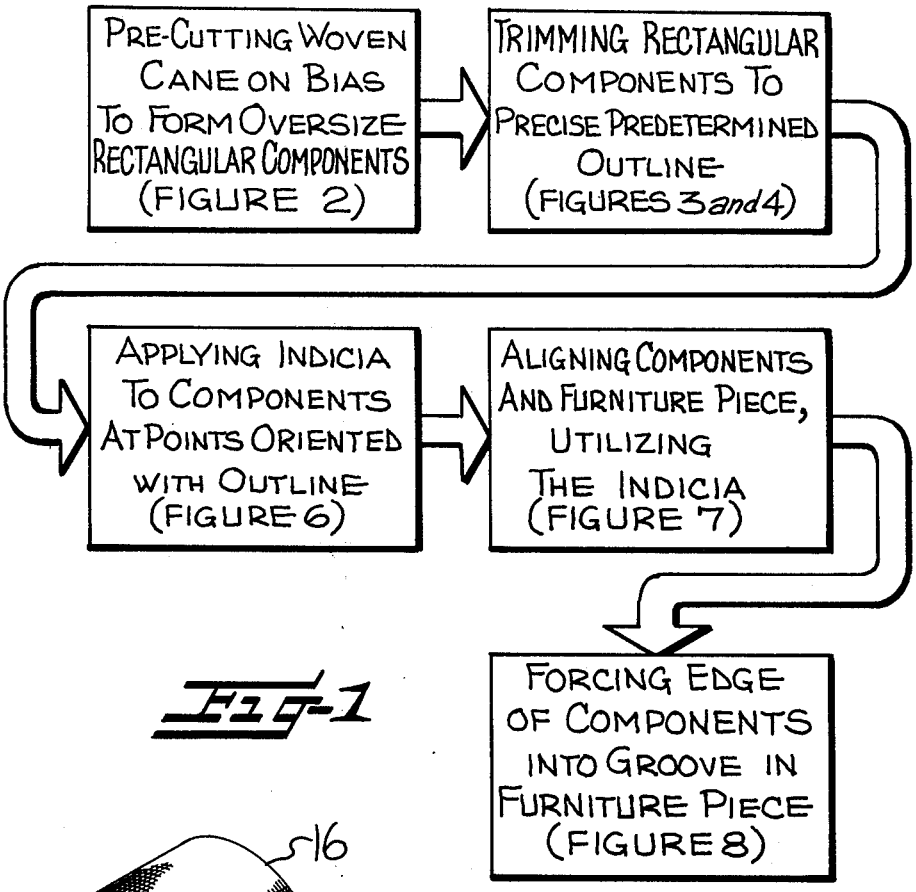
Figure 2:
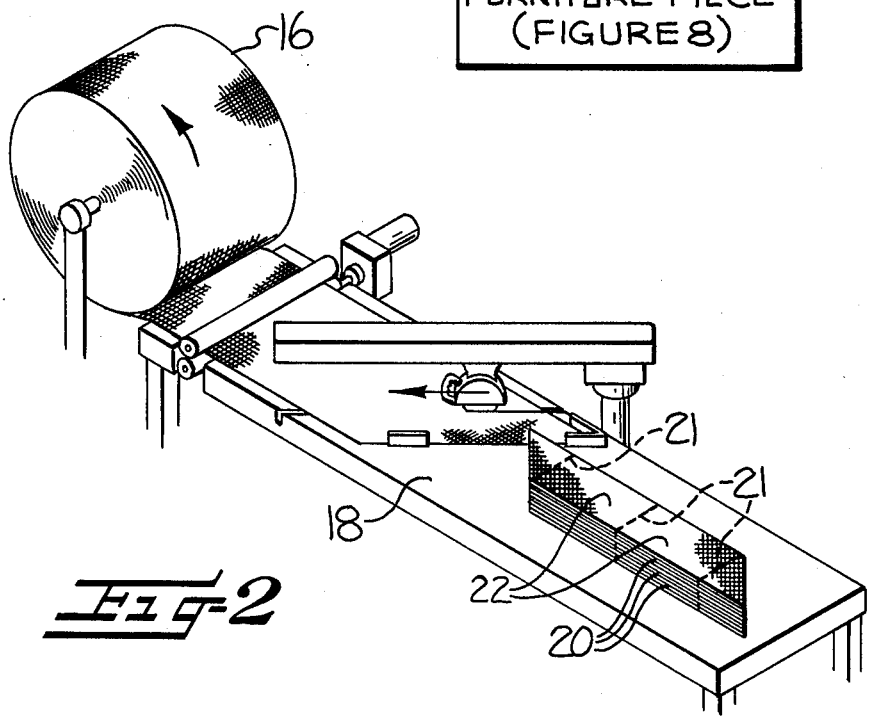
FIG. 2 is a schematic perspective view of a cutti apparatus for cutting a woven fabric material on t bias to form oversized rectangular components.

The fabric material, which as illustrated comprises an enwork woven material of either natural or "paper" ne, is usually supplied in a large roll as indicated at 16 FIG. 2. In accordance with the illustrated embodient of the present invention, the fabric material is wound from the roll 16 onto a cutting table 18, where is cut on a 45 degree bias to initially form intermediate bric products 20. The intermediate products are therter cut transversely along the indicated dashed lines l to form oversized rectangular fabric segments 22 FIG. 3). By this arrangement, the side edges of the sulting rectangular segments 22 are oriented in a constent and predetermined manner with respect to the eave pattern.

Figure 3:
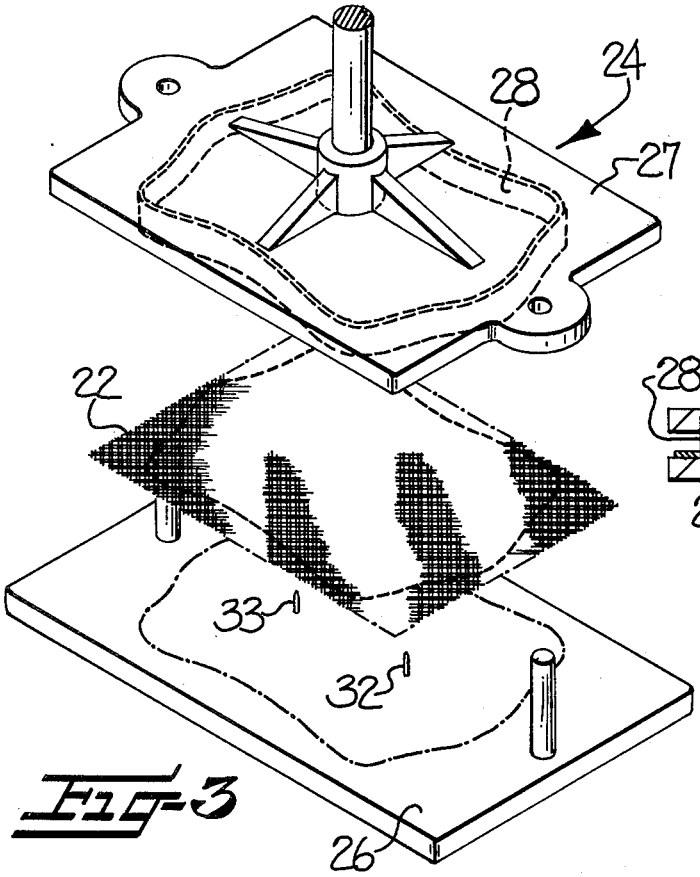
FIG. 3 is a schematic perspective view of a die c ting apparatus for trimming the rectangular compone to a precise predetermined outline.
Figure 4:
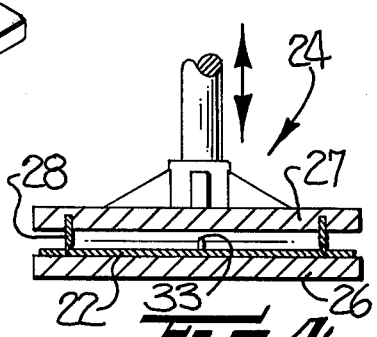
FIG. 4 is a sectional elevation view of the die cutti apparatus in the closed or cutting position.
Figure 10:
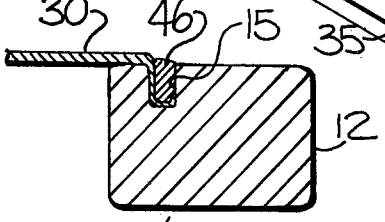
FIG. 10 is a fragmentary sectional view of the arti of furniture illustrating the manner in which the fab component is secured in the channel.

The rectangular segments 22 are individually deliv-ed to a die cutting apparatus as schematically illusated at 24 in FIGS. 3 and 4, and which comprises a ctangular bed 26 and a vertically reciprocable cutting late 27. The cutting plate includes a continuous flange r cutting blade 28, which by design accurately conrms in a predetermined oversized relationship to the eripheral outline of the channel 15 formed about the pening in the chair back 12. More particularly, the lade 28 is configured so as to be adapted to cut the gments 22 into components 30 having a peripheral lge which also accurately conforms in the predeterined oversized relationship to the peripheral outline of e channel 15, and so that the component is adapted to verlie the opening in the chair back with the entire tent of the peripheral edge thereof being disposed ithin the channel, and as illustrated in FIG. 10.

Figure 6:
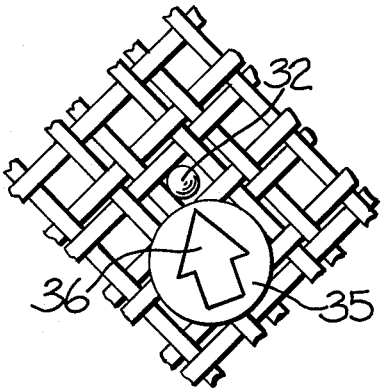
FIG. 6 is a fragmentary plan view illustrating t indicium applied to the fabric.
Figure 5:
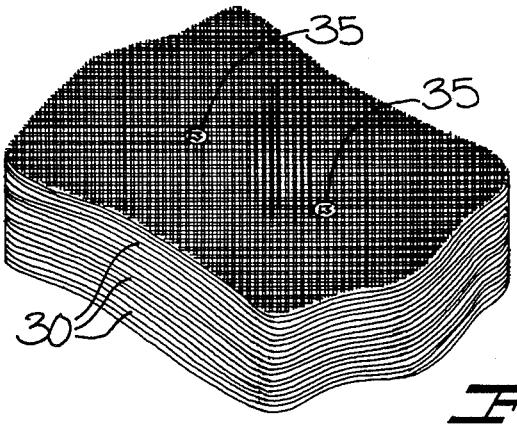
FIG. 5 is a perspective view of a plurality of stack components after having been trimmed on the cutti apparatus.

The bed 26 includes two widely spaced pins 32, 33 xed thereon, and the segments 22 are individually laced on the bed such that the pins 32, 33 penetrate spective interstices of the fabric, note FIG. 6. Also, ne side edge of the rectangular segment 22 is aligned ith the edge of the bed, or with a suitable marking (not own) on the bed, to thereby insure that the weave attern is consistently oriented on the bed from compoent to component. The interstices penetrated by the ins 32, 33 define predetermined locations on the segent 22, and thus the resulting component 30, with spect to the peripheral outline of the associated chanel, for the purposes described below. Also, an indicium the form of a releasble sticker 35 or other suitable ark is applied to the segment 22 while it is positioned n the bed 26 so as to indicate each of the interstices rough which the pins 32, 33 have penetrated. As illusated, the sticker 35 includes a printed arrow 36 which oints to the appropriate interstices.

To effect cutting, the cutting plate 27 is lowered by a itable mechanism (not shown) to the position illusated in FIG. 4. The plate 27 is then raised and the sulting component 30 is removed from the bed and laced on a stack of similar components as shown in IG. 5. As will become apparent, these initial steps of e process may be conducted at one location, such as e plant at which the fabric is woven, and the remaining steps as described below may be carried out at a remote furniture plant to which the components 30 are shipped.

Figure 7:
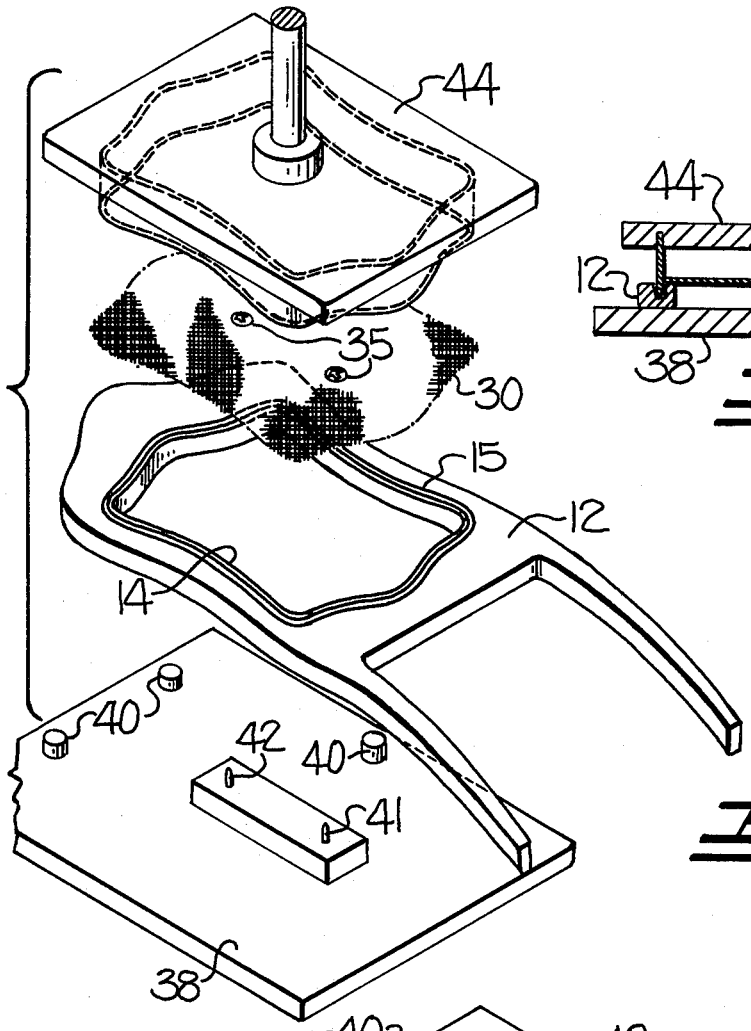
FIG. 7 is a schematic perspective view of an appa tus for assembling the fabric components to an article furniture.
Figure 8:
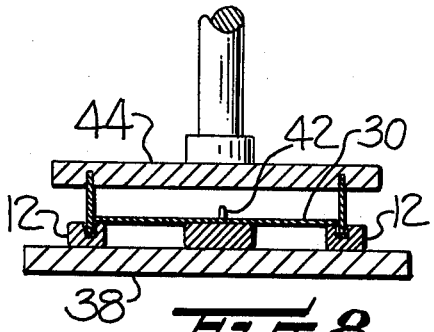
FIG. 8 is a sectional elevation view of the assemb apparatus in its closed position.
Figure 9:
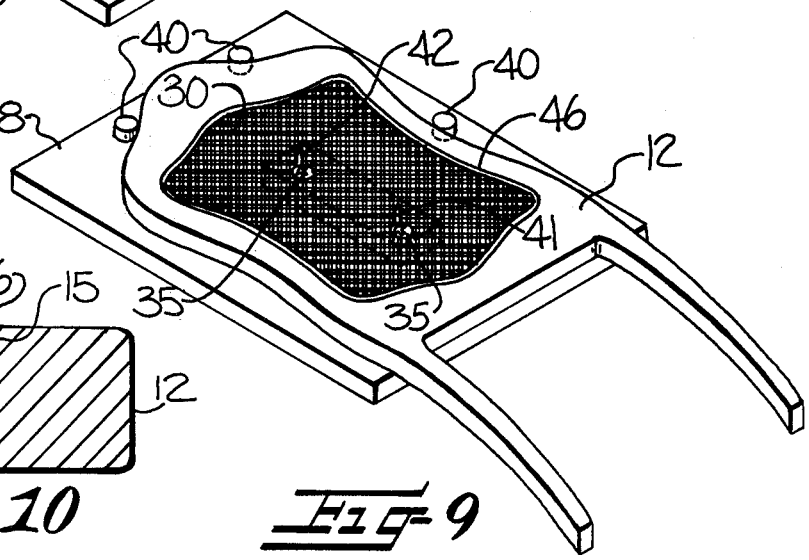
FIG. 9 is a perspective view of the assembly table the assembly apparatus, and with the article of furnit positioned thereon.

The assembly of the fabric component 30 to the chair back 12 utilizes an apparatus as schematically illustrated at 37 in FIGS. 7–9, and which includes a table 38 having guide means in the form of three posts 40 for accurately positioning the chair back 12 thereon at a predetermined location. Also, the table 38 mounts a pair of upstanding pegs 41, 42 which by design are respectively positioned at each of the above defined predetermined locations with respect to the channel 15 of the thusly placed chair back 12. The apparatus 37 further includes an upper vertically reciprocable die plate 44, which has a downwardly directed continuous flange 45 which is shaped to match the outline of the channel 15 in the chair back 12.

With the chair back 12 positioned on the table 38, a cut fabric component 30 is positioned so as to overlie the opening 14 therein, and the component 30 is aligned so that the pegs 41, 42 penetrate the interstices indicated by the stickers 35. Stated in other words, the pegs 41, 42 penetrate the same interstices which were previously penetrated by the pins 32, 33 at the die cutting apparatus. As will thus be apparent, the component 30 is thereby aligned with respect to the channel 15 in the chair back 12, so that the peripheral edge of the component accurately conforms in the desired oversized relationship to the peripheral outline of the channel 15. Further, upon the plate 44 being lowered to the position of FIG. 8, the entire edge of the component 30 is concurrently forced into the channel, and the entire extent of the peripheral edge of the component will be wholly disposed within the channel, without any portion of the edge extending back out and beyond the channel. Thus any need for a subsequent trimming operation is avoided. During this forcing process, the pegs 41, 42 serve the further function of preventing the component 30 from laterally shifting with respect to the channel.

In the case of natural cane, the component 30 is preferably soaked in water to soften the cane just prior to the peripheral edge being forced into the channel, to thereby avoid possible breakage of the cane strips at the edge. The wetting also causes the cane to shrink slightly while drying, to provide added tightness across the opening.

To complete the assembly operation, a spline 46 (FIG. 10) is placed within the channel along the full extent thereof and upon the peripheral edge of the component. Preferably, glue is also applied within the channel, to securely retain the edge of the component and the spline therein. A finish may be thereafter applied to the cane in a conventional manner after the chair is fully assembled.

In the drawings and specification, there has been set forth a preferred embodiment of the invention, and although specific terms are employed, they are used in a generic and descriptive sense only and not for purposes of limitation.

That which is claimed is:

1. A method for assembling a fabric material, such as woven cane, in a continuous channel in an article of furniture, and so as to cover the area encompassed by the channel, and characterized by the absence of a manual trimming operation, and comprising the steps of cutting the fabric material into a component having a peripheral edge which accurately conforms in a predetermined oversized relationship to the peripheral outline of the channel in the article of furniture and so that the component is adapted to overlie the area encompassed by the channel with the entire extent of the peripheral edge of the component being disposed within the channel, applying indicium at at least two widely spaced positions on the component, with said positions being respectively disposed to indicate predetermined locations with respect to the peripheral outline of the associated channel in the article of furniture, placing the component with the indicia applied thereto so as to overlie the area encompassed by the channel in the article of furniture, while orienting the indicia on the component at said predetermined locations with respect to the peripheral outline of the channel, and then forcing the peripheral edge of the component into the channel, and whereby the entire extent of the peripheral edge of the component is disposed within the channel.

2. The method as defined in claim 1 wherein the step of cutting the fabric material includes aligning the pattern of the fabric in a predetermined manner with respect to the resulting peripheral edge of the cut component, and so that the pattern is consistently oriented with respect to its edge from component to component.

3. The method as defined in either of claims 1 or 2 wherein the step of forcing the peripheral edge of the component into the channel includes moving the entire peripheral edge concurrently into the channel.

4. The method as defined in claim 1 comprising the further subsequent step of placing a spline within the channel and upon the peripheral edge of said component, to retain the edge thereof in the channel.

5. The method as defined in claim 4 comprising the further step of applying glue within the channel to further retain the edge of the component and the spline therein.

6. The method as defined in claim 1 wherein the step of cutting the fabric material comprises placing the fabric material on the bed of a die cutting apparatus, with the bed having means fixed thereon for indicating each of said predetermined locations on the cut component.

7. The method as defined in claim 6 wherein the step of applying indicium is carried out while the fabric material is on the bed of the die cutting apparatus, and while referencing said indicating means thereon.

8. The method as defined in claim 7 wherein the step of placing the component to overlie the area encompassed by the channel in the article of furniture includes placing the article of furniture on an assembly table having guide means for accurately locating the article of furniture thereon and locating means for indicating each of said predetermined locations with respect to the channel of the thusly placed article of furniture, and the orienting of the indicia on the component at said pred termined locations includes aligning said indicia wi respect to said locating means of said table.

9. A method for assembling an openwork, wove fabric material, such as woven cane, in a channel whic surrounds an opening in an article of furniture, and so to cover the opening therein, and characterized by tl absence of a manual trimming operation, and compri ing the steps of cutting the fabric material into a rectangular segme with the side edges thereof being oriented in predetermined manner with respect to the weav pattern, placing the fabric segment on the bed of a die cuttir apparatus having at least two widely spaced pi fixed thereon and while orienting the edge of tl segment in a predetermined manner with respect t said pins, and such that the pins penetrate respe tive interstices of the oriented fabric, cutting the fabric segment while it is placed upon sai bed into a component having a peripheral edg which accurately conforms in a predetermine oversized relationship to the peripheral outline the channel in the article of furniture and so th the component is adapted to overlie the opening i the article of furniture with the entire extent of th peripheral edge of the component being dispose within the channel, and such that the interstice penetrated by the pins define predetermined loc tions on the component with respect to the peripl eral outline of the associated channel, applying indicia on the component so as to indicat each of the interstices through which said pir have penetrated, placing the article of furniture upon an assembly tabl having guide means for accurately positioning th article of furniture thereon and upstanding peg which are respectively positioned at each of sai predetermined locations with respect to the char nel of the thusly placed article of furniture, placing the cut fabric component with the indici applied thereto so as to overlie the opening in th thusly placed article of furniture, and includin orienting the component so that the pegs penetrat the interstices indicated by the indicia, and then forcing the peripheral edge of the component into th channel, and whereby the entire extent of the pe ripheral edge of the component is disposed withi the channel.

10. The method as defined in claim 9 wherein th entire peripheral edge of the component is concurrentl forced into the channel, and comprising the furthe subsequent step of placing a spline within the channe along the full extent thereof and so as to retain the pe ripheral edge of the component in the channel.

* * * * *